US010619635B2

(12) United States Patent
Branch et al.

(10) Patent No.: US 10,619,635 B2
(45) Date of Patent: Apr. 14, 2020

(54) SCALLOP STEP FOR A SCROLL COMPRESSOR

(71) Applicant: TRANE INTERNATIONAL INC., Davidson, NC (US)

(72) Inventors: Scott M. Branch, Tomah, WI (US); Eric S. Mlsna, Cashton, WI (US); Scott J. Smerud, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 279 days.

(21) Appl. No.: 15/654,027

(22) Filed: Jul. 19, 2017

(65) Prior Publication Data

US 2018/0023569 A1 Jan. 25, 2018

Related U.S. Application Data

(60) Provisional application No. 62/365,222, filed on Jul. 21, 2016.

(51) Int. Cl.
*F04C 18/02* (2006.01)

(52) U.S. Cl.
CPC ..... *F04C 18/0215* (2013.01); *F04C 18/0284* (2013.01)

(58) Field of Classification Search
CPC ..... F04C 18/0215; F04C 18/0284
See application file for complete search history.

(56) References Cited

U.S. PATENT DOCUMENTS

| | | | | |
|---|---|---|---|---|
| 4,594,061 | A * | 6/1986 | Terauchi | F04C 18/0215 418/55.2 |
| 5,056,336 | A | 10/1991 | Harrison et al. | |
| 5,944,500 | A * | 8/1999 | Iizuka | F04C 18/0215 418/55.2 |
| 9,145,770 | B2 * | 9/2015 | Hirata | F04C 18/0215 |
| 2003/0108444 | A1 | 6/2003 | Ito et al. | |
| 2007/0036668 | A1 | 2/2007 | Lifson et al. | |
| 2016/0131134 | A1 | 5/2016 | Kakuda et al. | |

FOREIGN PATENT DOCUMENTS

| | | | |
|---|---|---|---|
| CN | 201539412 | U | 8/2010 |
| CN | 102197223 | A | 9/2011 |
| CN | 102725531 | A | 10/2012 |
| CN | 203321824 | U | 12/2013 |

OTHER PUBLICATIONS

Extended European Search Report; European Patent Application No. 17182546.6, dated Aug. 29, 2017 (7 pages).

* cited by examiner

*Primary Examiner* — Mary Davis
(74) *Attorney, Agent, or Firm* — Hamre, Schumann, Mueller & Larson, P.C.

(57) ABSTRACT

A scroll member for a scroll compressor is disclosed. The scroll member includes a base member and a wrap member formed on a major surface of the base member. The wrap member includes a modified portion. The modified portion includes a base, a step, and a scallop. The base extends a first distance from the major surface. The step extends a second distance from the base. The scallop extends a third distance from the scallop. The scallop is located at a wrap surface of the wrap member. The wrap surface is disposed relatively away from the major surface relative to the step.

19 Claims, 6 Drawing Sheets

SCALLOP STEP FOR A SCROLL COMPRESSOR

FIELD

This disclosure relates generally to vapor compression systems. More specifically, this disclosure relates to a scroll configuration of a scroll compressor in a vapor compression system such as, but not limited to, a heating, ventilation, and air conditioning (HVAC) system.

BACKGROUND

One type of compressor for a vapor compression system is generally referred to as a scroll compressor. Scroll compressors generally include a pair of scroll members which orbit relative to each other to compress a working fluid such as, but not limited to, air or a refrigerant. A typical scroll compressor includes a first, stationary scroll member having a base and a generally spiral wrap extending from the base, and a second, orbiting scroll member having a base and a generally spiral wrap extending from the base. The spiral wraps of the first and second orbiting scroll members are interleaved, creating a series of compression chambers. The second, orbiting scroll member is driven to orbit the first, stationary scroll member by rotating a shaft. Some scroll compressors employ an eccentric pin on the rotating shaft that drives the second, orbiting scroll member.

SUMMARY

This disclosure relates generally to vapor compression systems. More specifically, this disclosure relates to a scroll configuration of a scroll compressor in a vapor compression system such as, but not limited to, a heating, ventilation, and air conditioning (HVAC) system.

In an embodiment, an orbiting scroll member and a non-orbiting scroll member are intermeshed. In an embodiment, the orbiting scroll member includes a modified tip portion. The modified tip portion can include a base, a step, and a scallop. A thickness of the base can be relatively greater than a thickness of the step. The thickness of the step can be relatively greater than a thickness of the scallop.

In an embodiment, the modified tip portion including the base, step, and scallop can be referred to as a scallop step. The scallop step can, in an embodiment, provide an increased flow area for an indirect pressure chamber. In an embodiment, the scallop step can reduce an over-pressurization of the working fluid. In an embodiment, reducing over-pressurization of the working fluid can result in an increased efficiency of the scroll compressor. In an embodiment, the increased efficiency may be particularly significant when the compressor is operating at a part load. For example, in an embodiment, when operating at or about a 75% load, an efficiency of the scroll compressor having the scallop step can be at or about 1% higher than an efficiency of a scroll compressor without the scallop step. For example, in an embodiment, 1% higher efficiency at 75% load means that efficiency is 1% higher at compressor conditions set by operating a compressor unit at a 75% load point used in Integrated Energy Efficiency Ratio (LEER) calculations as defined in ANSI/AHRI STANDARD 210/240.

A scroll member for a scroll compressor is disclosed. The scroll member includes a base member and a wrap member formed on a major surface of the base member. The wrap member includes a modified portion. The modified portion includes a base, a step, and a scallop. The base extends a first distance from the major surface. The step extends a second distance from the base. The scallop extends a third distance from the scallop. The scallop is located at a wrap surface of the wrap member. The wrap surface is disposed relatively away from the major surface relative to the step.

A scroll compressor is also disclosed. The scroll compressor includes a compressor housing, a non-orbiting scroll member, and an orbiting scroll member intermeshed with the non-orbiting scroll member, forming a compression chamber within the housing. A discharge port receives a compressed fluid and is configured to receive the compressed fluid from a direct pressure chamber and an indirect pressure chamber. The orbiting scroll member includes a base member and a wrap member formed on a major surface of the base member. The wrap member includes a modified portion. The modified portion includes a base, a step, and a scallop. The base extends a first distance from the major surface. The step extends a second distance from the base. The scallop extends a third distance from the scallop. The scallop is located at a wrap surface of the wrap member. The wrap surface is disposed relatively away from the major surface relative to the step.

A method for increasing a flow area in a scroll compressor is disclosed. The method includes modifying a tip portion of an orbiting scroll member. The orbiting scroll member includes a base member and a wrap member formed on a major surface of the base member. The modifying includes forming the tip portion to include a base, a step, and a scallop. The base extends a first distance from the major surface, the step extends a second distance from the base, and the scallop extends a third distance from the scallop. The scallop is located at a wrap surface of the wrap member. The wrap surface is disposed relatively away from the major surface relative to the step.

An HVAC system is disclosed. The HVAC system includes a condenser, an evaporator, an expansion device, and a compressor fluidly connected to form a heat transfer circuit. The compressor includes a compressor housing, a non-orbiting scroll member, and an orbiting scroll member intermeshed, forming a compression chamber within the housing. A discharge port receives a compressed fluid and is configured to receive the compressed fluid from a direct pressure chamber and an indirect pressure chamber. The orbiting scroll member includes a base member and a wrap member formed on a major surface of the base member. The wrap member includes a modified portion. The modified portion includes a base, a step, and a scallop. The base extends a first distance from the major surface. The step extends a second distance from the base. The scallop extends a third distance from the scallop. The scallop is located at a wrap surface of the wrap member. The wrap surface is disposed relatively away from the major surface relative to the step.

BRIEF DESCRIPTION OF THE DRAWINGS

References are made to the accompanying drawings that form a part of this disclosure and which illustrate embodiments in which the systems and methods described in this specification can be practiced.

FIG. 2A illustrates a partial sectional view of the scroll compressor, according to an embodiment. FIG. 2B illustrates a sectional view of scroll members along a line 2B-2B in FIG. 2A, according to an embodiment.

Like reference numbers represent like parts throughout.

DETAILED DESCRIPTION

Figure 1:
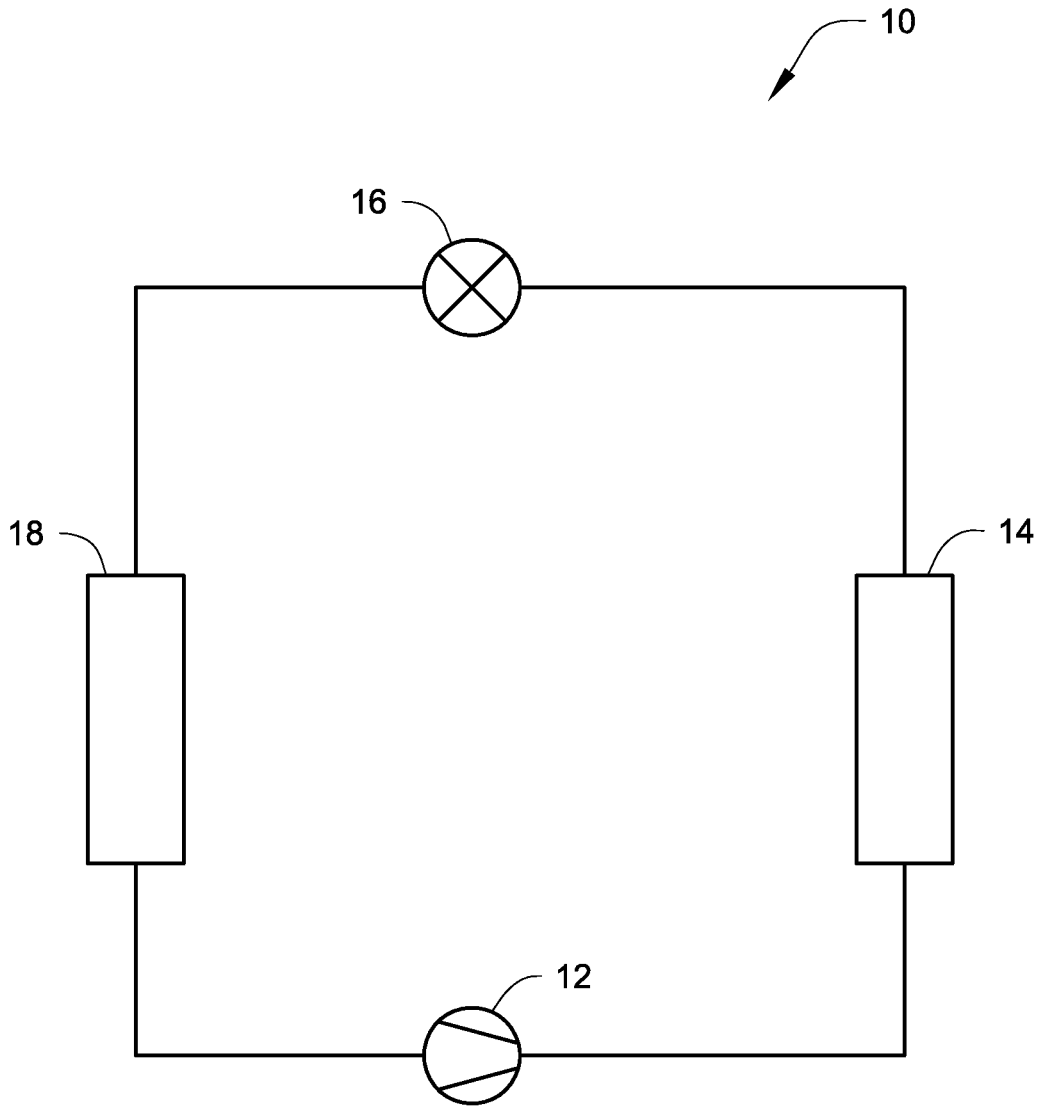
FIG. 1 is a schematic diagram of a heat transfer circuit, according to an embodiment.

This disclosure relates generally to vapor compression systems. More specifically, this disclosure relates to a scroll configuration of a scroll compressor in a vapor compression system such as, but not limited to, a heating, ventilation, and air conditioning (HVAC) system.

A scroll compressor may be used to compress a working fluid (e.g., air, heat transfer fluid (such as, but not limited to, refrigerant, or the like), etc.). A scroll compressor can be included in an HVAC system to compress a heat transfer fluid in a heat transfer circuit. The scroll compressor generally includes a fixed scroll member (e.g., non-orbiting scroll member) and an orbiting scroll member intermeshed with each other, forming compression chambers. The compression chambers may include a direct pressure chamber and an indirect pressure chamber, according to an embodiment. In an embodiment, the non-orbiting scroll member can include a portion which is modified to, for example, control an amount of compression of the working fluid.

In an embodiment, the orbiting scroll portion which is modified can be referred to as a scalloped portion. The scalloped portion can include a stepped configuration. Accordingly, the modified portion of the orbiting scroll member can generally be referred to as a scallop step. In an embodiment, the scallop step can reduce an over-pressurization of the working fluid. In an embodiment, reducing over-pressurization of the working fluid can result in an increased efficiency of the scroll compressor. The increased efficiency can be particularly significant when the scroll compressor is operated at a part load. For example, in an embodiment, when operating at or about a 75% load, an efficiency of the scroll compressor having the scallop step can be at or about 1% higher than an efficiency of a scroll compressor without the scallop step. In an embodiment, the scallop step of the orbiting scroll member can increase a discharge area of the indirect pressure chamber. Increasing the discharge area can reduce an amount of over-pressurization, thereby increasing an efficiency of the scroll compressor.

A direct pressure chamber, as used in this specification, generally refers to a compression chamber in a scroll compressor in which, when the orbiting scroll member and the non-orbiting scroll member are in a discharge configuration in which the direct pressure chamber fluidly communicates with a discharge port, a plurality of areas overlap with the discharge port such that the working fluid can be provided to the discharge port via the plurality of areas.

An indirect pressure chamber, as used in this specification, generally refers to a compression chamber in a scroll compressor in which, when the orbiting scroll member and the non-orbiting scroll member are in the discharge configuration in which the indirect pressure chamber fluidly communicates with the discharge port, the working fluid is in fluid communication with the discharge port via a space between the orbiting and the non-orbiting scroll members.

FIG. 1 is a schematic diagram of a heat transfer circuit 10, according to an embodiment. The heat transfer circuit 10 generally includes a compressor 12, a condenser 14, an expansion device 16, and an evaporator 18. The compressor 12 can be, for example, a scroll compressor such as the scroll compressor shown and described in accordance with FIG. 2A below. The heat transfer circuit 10 is an example and can be modified to include additional components. For example, in an embodiment, the heat transfer circuit 10 can include other components such as, but not limited to, an economizer heat exchanger, one or more flow control devices, a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of such systems include, but are not limited to, HVAC systems, transport refrigeration systems, or the like.

The compressor 12, condenser 14, expansion device 16, and evaporator 18 are fluidly connected. In an embodiment, the heat transfer circuit 10 can be configured to be a cooling system (e.g., an air conditioning system) capable of operating in a cooling mode. In an embodiment, the heat transfer circuit 10 can be configured to be a heat pump system that can operate in both a cooling mode and a heating/defrost mode.

The heat transfer circuit 10 operates according to generally known principles. The heat transfer circuit 10 can be configured to heat or cool a heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 12 compresses a heat transfer fluid (e.g., refrigerant or the like) from a relatively lower pressure gas to a relatively higher-pressure gas. The relatively higher-pressure gas is also at a relatively higher temperature, which is discharged from the compressor 12 and flows through the condenser 14. In accordance with generally known principles, the heat transfer fluid flows through the condenser 10 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer medium (e.g., water, air, etc.), heating the heat transfer fluid, and converting it to a gaseous form. The gaseous heat transfer fluid then returns to the compressor 12. The above-described process continues while the heat transfer circuit 10 is operating, for example, in a cooling mode (e.g., while the compressor 12 is enabled).

Figure 2A:
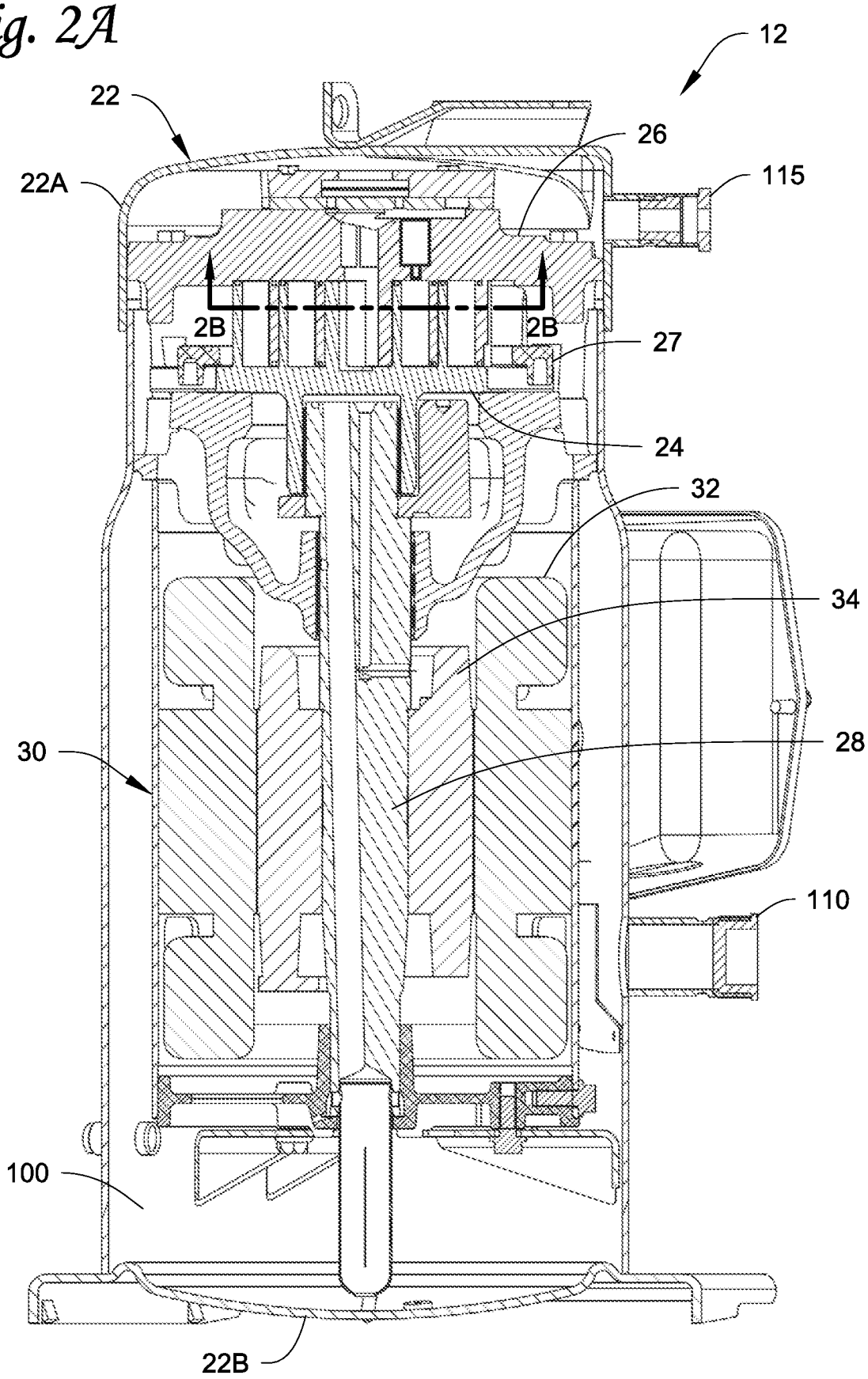
FIGS. 2A-2B illustrate sectional views of a compressor with which embodiments disclosed in this specification can be practiced, according to an embodiment.

FIG. 2A illustrates a sectional view of the compressor 12 with which embodiments as disclosed in this specification can be practiced, according to an embodiment. The compressor 12 can be used in the heat transfer circuit 10 of FIG. 1. It is to be appreciated that the compressor 12 can also be used for purposes other than in a heat transfer circuit. For example, the compressor 12 can be used to compress air or gases other than a heat transfer fluid (e.g., natural gas, etc.). It is to be appreciated that the scroll compressor 12 includes additional features that are not described in detail in this specification. For example, the scroll compressor 12 includes a lubricant sump 100 for storing lubricant to be introduced to the moving features of the scroll compressor 12.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more compression stages. Generally, the embodiments as disclosed in this specification are suitable for a compressor with a vertical or a near vertical crankshaft (e.g., crankshaft 28). It is to be appreciated that the embodiments may also be applied to a horizontal compressor.

The compressor 12 is illustrated in sectional side view. The scroll compressor 12 includes an enclosure 22. The enclosure 22 includes an upper portion 22A and a lower portion 22B. The compressor 12 includes a suction inlet 110 and a discharge outlet 115.

The compressor 12 includes an orbiting scroll member 24 and a non-orbiting scroll member 26. The non-orbiting scroll member 26 can alternatively be referred to as, for example, the stationary scroll member 26, the fixed scroll member 26, or the like. The non-orbiting scroll member 26 is aligned in meshing engagement with the orbiting scroll member 24 by means of an Oldham coupling 27.

The compressor 12 includes a driveshaft 28. The driveshaft 28 can alternatively be referred to as the crankshaft 28. The driveshaft 28 can be rotatably driven by, for example, an electric motor 30. The electric motor 30 can generally include a stator 32 and a rotor 34. The driveshaft 28 is fixed to the rotor 34 such that the driveshaft 28 rotates along with the rotation of the rotor 34. The electric motor 30, stator 32, and rotor 34 can operate according to generally known principles. The driveshaft 28 can, for example, be fixed to the rotor 34 via an interference fit or the like. The driveshaft 28 can, in an embodiment, be connected to an external electric motor, an internal combustion engine (e.g., a diesel engine or a gasoline engine), or the like. It will be appreciated that in such embodiments the electric motor 30, stator 32, and rotor 34 would not be present in the compressor 12.

Figure 2B:
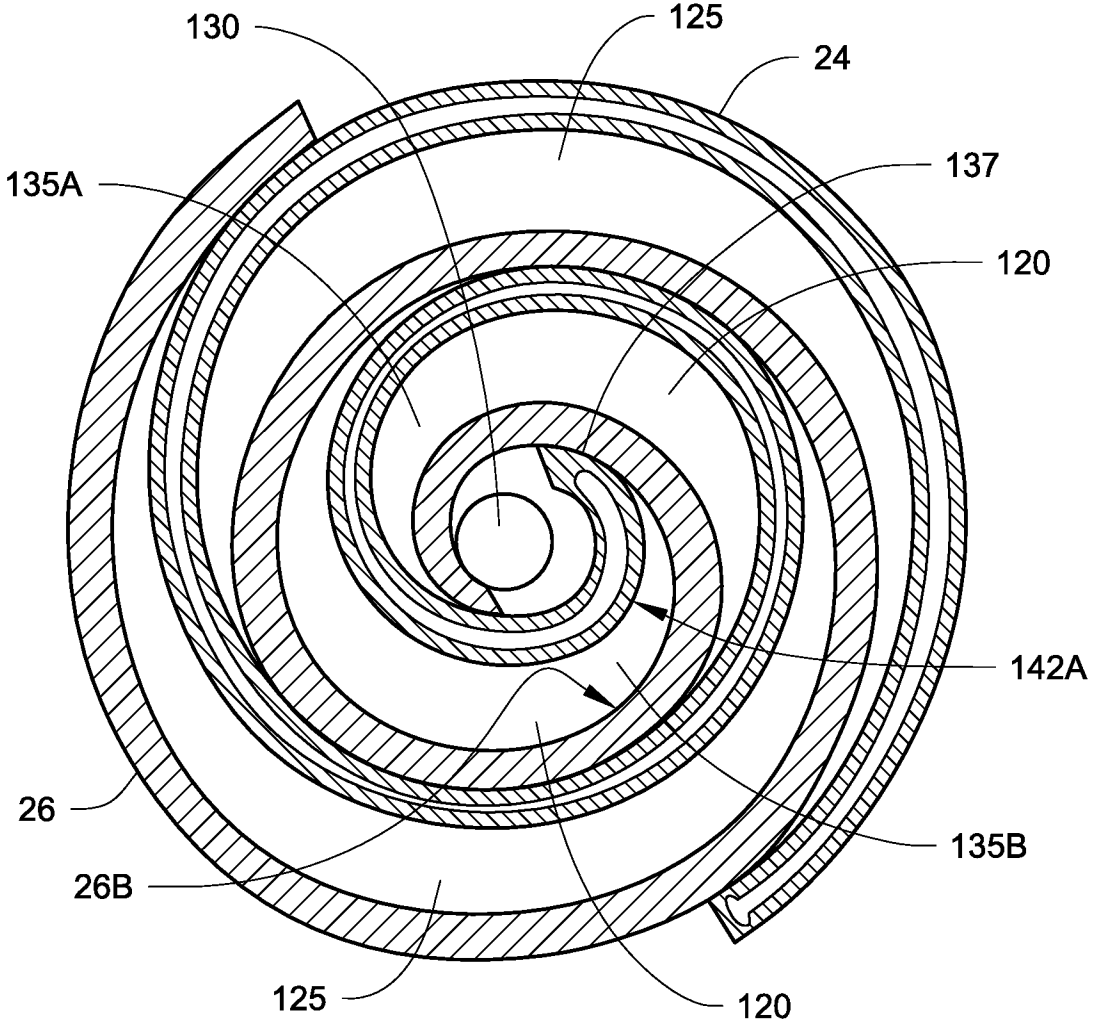

FIG. 2B illustrates a sectional view of scroll members 24, 26 along a line 2B-2B in FIG. 2A, according to an embodiment. The orbiting scroll member 24 and the non-orbiting scroll member 26 can form a plurality of moving compression chambers 120, 125. A working fluid (e.g., heat transfer fluid such as refrigerant or the like) can be compressed in the compression chambers 120, 125. The compressed working fluid can be directed out of the scroll compressor 12 from a discharge port 130. The discharge port 130 may be in fluid communication with the discharge outlet 115 (FIG. 2A) to discharge the compressed working fluid.

Of the plurality of compression chambers 120, 125, one of the compression chambers can generally be referred to as a direct pressure chamber 135A and another can be referred to as an indirect pressure chamber 135B. The direct pressure chamber 135A is disposed such that when the orbiting scroll member 24 and the non-orbiting scroll member 26 revolve to a configuration in which the working fluid is being discharged via the discharge port 130 (e.g., a discharge configuration), a plurality of areas of the direct pressure chamber 135A fluidly communicate with the discharge port 130. The plurality of areas can include, for example, an area on each side of the scroll member 26. In the discharge configuration, the indirect pressure chamber 135B is fluidly connected to the discharge port 130 via an area 137 disposed between an outer surface 142A of the orbiting scroll member 24 and an inner surface 26B of the non-orbiting scroll member 26. In an embodiment, the area 137 is a single area. In the illustrated figure, the area 137 is closed, but as the scroll members 24, 26 revolve to the discharge configuration, the area 137 defined between the outer surface 142A and the inner surface 26B opens and fluidly communicates with the discharge port 130.

It will be appreciated that the scroll members 24, 26 can include one or more additional features such as, but not limited to, a surface modified portion (see FIGS. 3-5 below), a gasket/seal disposed in a groove of, for example, the orbiting scroll member 24, or the like.

Figure 3:
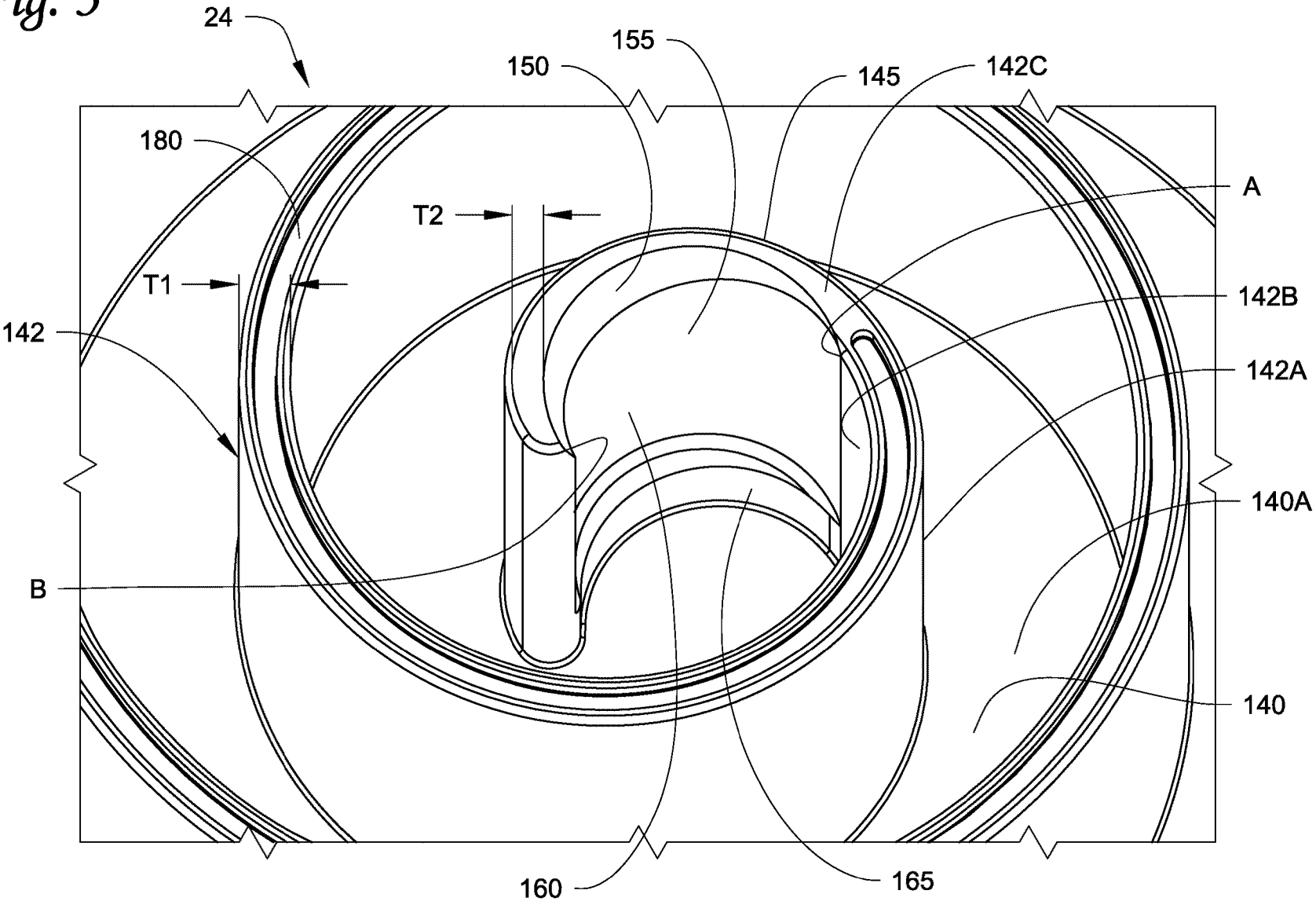
FIG. 3 illustrates a perspective view of a portion of an orbiting scroll member with which embodiments disclosed in this specification can be practiced, according to an embodiment.
Figure 4:
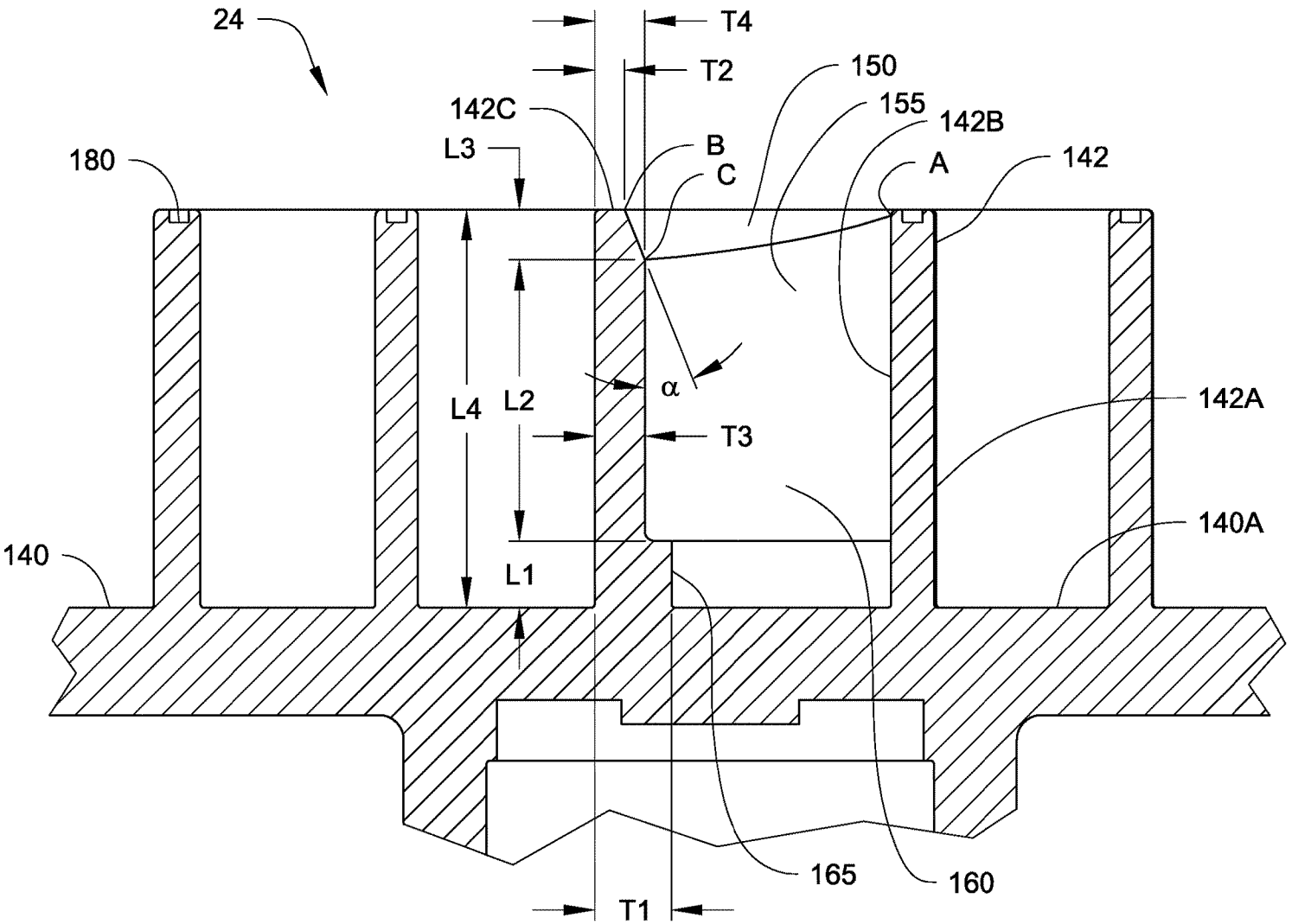
FIG. 4 illustrates a sectional view of a portion of an orbiting scroll member with which embodiments disclosed in this specification can be practiced, according to an embodiment.
Figure 5:
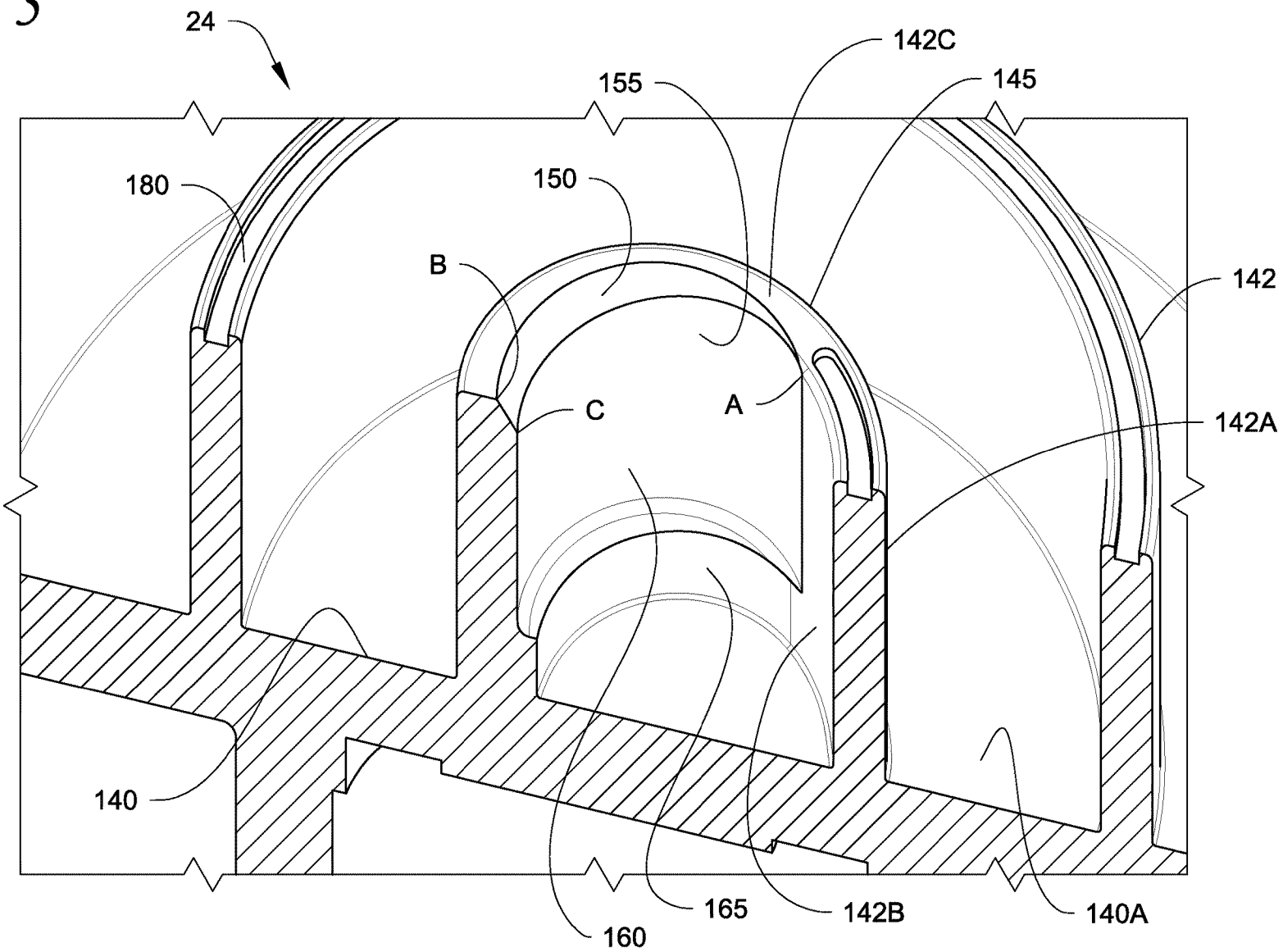
FIG. 5 illustrates a sectional view of a portion of an orbiting scroll member with which embodiments disclosed in this specification can be practiced, according to an embodiment.

FIGS. 3-5 illustrate several views of a portion of an orbiting scroll member 24 with which embodiments disclosed in this specification can be practiced, according to an embodiment. FIG. 3 illustrates a perspective view of portions of the orbiting scroll member 24. FIGS. 4-5 illustrate sectional views of portions of the orbiting scroll member 24.

The orbiting scroll member 24 includes a base member 140 and a wrap member 142. In an embodiment, the wrap member 142 includes an outer surface 142A, an inner surface 142B, and a wrap surface 142C. The wrap surface 142C is about parallel to a major surface 140A of the base member 140 and faces away from the major surface 140A of the base member 140. In an embodiment, the base member 140 and the wrap member 142 are a single-piece, integrally formed construction.

In the illustrated embodiment, a tip portion 145 of the wrap member 142 of the orbiting scroll member 24 is modified. In an embodiment, the remainder of the wrap member 142 (e.g., other than the tip portion 145) can be substantially uniform. The modified portion of the tip portion 145 extends from a first point A of the tip portion 145 to a second point B of the tip portion 145. The second point B is disposed at or about an end of the wrap member 142. The modification to the tip portion 145 includes a scallop 150 and a step 155. Collectively, the scallop 150 and the step 155 will generally be referred to as the scallop step 160. The first point A can be disposed at a location of the orbiting scroll member 24 at which the direct pressure chamber 135A (FIG. 2B) is just starting to fluidly communicate with the discharge port 130 (FIG. 2B) during a compression cycle of the orbiting and non-orbiting scroll members 24, 26. In an embodiment, the first point A can be located where the scallop step 160 can result in a more rapid opening of the indirect pressure chamber 135B (FIG. 2B) at a same clock angle as the direct pressure chamber 135A opens to the discharge port 130.

The scallop step 160 can increase a flow area for the working fluid flowing from the indirect pressure chamber 135B to the discharge port 130. Increasing the flow area for the working fluid can increase a flow of working fluid from the indirect pressure chamber 135B to the discharge port 130. In an embodiment, this can reduce an amount of over-pressurization of the working fluid in the indirect pressure chamber 135B. Reducing the amount of over-pressurization of the working fluid in the indirect pressure chamber 135B can, for example, increase an efficiency of the compressor 12. For example, in an embodiment, when operating at or about a 75% load, an efficiency of the scroll compressor 12 having the scallop step 160 can be at or about 1% higher than an efficiency of a scroll compressor without the scallop step 160.

The scallop step 160 includes a base portion 165, the step 155, and the scallop 150. In the illustrated embodiment, the scallop step 160 is shown on the orbiting scroll member 24. In an embodiment, the scallop step 160 can alternatively be on the non-orbiting scroll member 26. The location of the scallop step on the non-orbiting scroll member 26 would be selected to increase a flow area for the working fluid flowing from the indirect pressure chamber 135B to the discharge port 130. The base portion 165 can extend a distance L1 from the major surface 140A of the orbiting scroll member 24. The step 155 can extend a distance L2 from the base portion 165. The scallop 150 can extend a distance L3 from the step 155 to the wrap surface 142C of the orbiting scroll member 24. The distances L1, L2, and L3 collectively add up to a distance L4 from the major surface 140A to the wrap surface 142C. The distances L2 and L3 can vary between the first point A and a third point C. Even as the distances L2 and L3 vary between the first point A and the third point C, the collective distance L1, L2, L3 (e.g., L4) remains constant or substantially constant from the first point A to the third point C. In general, the length L2 can be greatest at the first point A and will get relatively smaller along the wrap member 142 up to the third point C. Conversely, the length L3 can be greatest at the third point C and will get relatively smaller along the wrap member up to the first point A.

The wrap member 142 generally has a thickness T1 between the outer surface 142A and the inner surface 142B. In the illustrated embodiment, the thickness T1 is illustrated at multiple locations for illustrative purposes. The thickness of the wrap member 142 at the first point A is T1. The thickness between the first point A and the second point B (along the wrap member 142) varies. For example, the thickness at or about the second point B can be T2. In an embodiment, T2 can be relatively less than T1. Further, it will be appreciated that a thickness of the wrap member 142 in the modified portion 145 can vary along the scallop step 160. That is, the thickness of the wrap member 142 at or about the wrap surface 142C can be T2. A thickness of the wrap member 142 in the base portion 165 can be T1; a thickness of the wrap member 142 in the step 155 can be T3; and a thickness of the wrap member 142 in the scallop can be T4. In an embodiment, the thickness T1 can be greater than the thickness T2. In an embodiment, the thickness T3 can be less than the thickness T1, but greater than the thickness T2. In an embodiment, the thickness T4 can be greater than the thickness T2. It will be appreciated that a thickness of the scallop 150 at a location which is adjacent to the step 155 can be the same as or similar to the thickness of the step 155. Further, a thickness of the scallop 150 at a location which is adjacent to the wrap surface 142 can be the same as or similar to the thickness of the wrap surface 142C.

In an embodiment, the thicknesses T1-T4 and the lengths L1-L4 can be selected to balance, for example, thermal expansion versus surface area of the wrap member 142. In an embodiment, the thicknesses T1-T4 and the lengths L1-L4 can be selected based on stresses applied to the wrap member 142 in operation such as, for example, to minimize stresses applied to the wrap member 142. Additionally, the ratios between any one of the thicknesses T1-T4 and/or the ratios between any one of the lengths L1-L4 can be selected to balance, for example, thermal expansion versus surface area of the wrap member 142 and/or to minimize stresses applied to the wrap member 142. Ratios between the thicknesses T1-T4 relative to the lengths L1-L4 can be selected to balance, for example, thermal expansion versus surface area of the wrap member 142 and/or to minimize stresses applied to the wrap member 142.

In an embodiment, an angle $\alpha$ (FIG. 4) of the scallop 150 can be based on, for example, manufacturing processes. Variation of the angle $\alpha$ of the scallop 150 can increase the effectiveness of the scallop 150, but may also increase a manufacturing time. For example, when the angle $\alpha$ decreases, the surface area of the scallop 150 increases, and the effectiveness of the scallop 150 may increase as well.

In an embodiment, the scallop step 160 can include a plurality of scallops 150 and/or a plurality of steps 155.

In the embodiments illustrated in FIGS. 4-5, the wrap member 142 includes a groove 180. The groove 180 can be configured to receive a gasket/seal member, according to an embodiment. As shown in FIG. 3, the wrap member 142 does not include the groove 180, according to an embodiment.

Aspects:

It is to be appreciated that any one of aspects 1-6 can be combined with any one of aspects 7-11, 12-14, or 15-19. Any one of aspects 7-11 can be combined with any one of aspects 12-14 or 15-19. Any one of aspects 12-14 can be combined with any one of aspects 15-19.

Aspect 1. A scroll member for a scroll compressor, comprising:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step.

Aspect 2. The scroll member according to aspect 1, wherein a thickness of the base is relatively greater than a thickness of the step.

Aspect 3. The scroll member according to aspect 2, wherein the thickness of the step is relatively greater than a thickness of the scallop.

Aspect 4. The scroll member according to any one of aspects 1-3, wherein the modified portion is disposed at a tip portion of the wrap member, the tip portion being disposed adjacent to a discharge port of the scroll compressor.

Aspect 5. The scroll member according to any one of aspects 1-4, wherein the base member and the wrap member are formed of a single piece, unitary construction.

Aspect 6. The scroll member according to any one of aspects 1-5, wherein the scroll member further includes a groove in the wrap surface of the wrap member.

Aspect 7. A scroll compressor, comprising:

a compressor housing;

a non-orbiting scroll member and an orbiting scroll member intermeshed forming a compression chamber within the housing; and a discharge port for receiving a compressed fluid, the discharge port configured to receive a working fluid from a direct pressure chamber and an indirect pressure chamber, wherein the orbiting scroll member includes:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step.

Aspect 8. The scroll compressor according to aspect 7, wherein the modified portion is arranged such that in a discharge configuration in which the direct pressure chamber and the indirect pressure chamber fluidly communicate with the discharge port, the modified portion provides an increased flow area for the indirect pressure chamber.

Aspect 9. The scroll compressor according to any one of aspects 7-8, wherein a thickness of the base is relatively greater than a thickness of the step.

Aspect 10. The scroll compressor according to aspect 9, wherein the thickness of the step is relatively greater than a thickness of the scallop.

Aspect 11. The scroll compressor according to any one of aspects 7-10, wherein the modified portion is disposed at a tip portion of the wrap member, the tip portion being disposed adjacent to a discharge port of the scroll compressor.

Aspect 12. A method for increasing a flow area in a scroll compressor, comprising:

modifying a tip portion of an orbiting scroll member, wherein the orbiting scroll member includes a base member and a wrap member formed on a major surface of the base member, the modifying including forming the tip portion to include a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step.

Aspect 13. The method according to aspect 12, wherein the modifying includes forming the tip portion such that a thickness of the base is relatively greater than a thickness of the step.

Aspect 14. The method according to aspect 13, wherein the modifying includes forming the tip portion such that the thickness of the step is relatively greater than a thickness of the scallop.

Aspect 15. A heating, ventilation, and air conditioning (HVAC) system, comprising:

a condenser, an evaporator, an expansion device, and a scroll compressor fluidly connected to form a heat transfer circuit, wherein the scroll compressor includes:

a compressor housing;

a non-orbiting scroll member and an orbiting scroll member intermeshed forming a compression chamber within the housing; and a discharge port for receiving a compressed fluid, the discharge port configured to receive a working fluid from a direct pressure chamber and an indirect pressure chamber, wherein the orbiting scroll member includes:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step.

Aspect 16. The HVAC system according to aspect 15, wherein the modified portion is arranged such that in a discharge configuration in which the direct pressure chamber and the indirect pressure chamber fluidly communicate with the discharge port, the modified portion provides an increased flow area for the indirect pressure chamber.

Aspect 17. The HVAC system according to any one of aspects 15 or 16, wherein a thickness of the base is relatively greater than a thickness of the step.

Aspect 18. The HVAC system according to aspect 17, wherein the thickness of the step is relatively greater than a thickness of the scallop.

Aspect 19. The HVAC system according to any one of aspects 15-18, wherein the modified portion is disposed at a tip portion of the wrap member, the tip portion being disposed adjacent to a discharge port of the scroll compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

What is claimed is:

1. A scroll member for a scroll compressor, comprising:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step, and the third distance increases from a first point of the modified portion to a second point of the modified portion disposed at an end of the wrap member.

2. The scroll member according to claim 1, wherein a thickness of the base is relatively greater than a thickness of the step.

3. The scroll member according to claim 2, wherein the thickness of the step is relatively greater than a thickness of the scallop.

4. The scroll member according to claim 1, wherein the modified portion is disposed at a tip portion of the wrap member, the tip portion being disposed adjacent to a discharge port of the scroll compressor.

5. The scroll member according to claim 1, wherein the base member and the wrap member are formed of a single piece, unitary construction.

6. The scroll member according to claim 1, wherein the scroll member further includes a groove in the wrap surface of the wrap member.

7. A scroll compressor, comprising:

a compressor housing;

a non-orbiting scroll member and an orbiting scroll member intermeshed forming a compression chamber within the housing; and a discharge port for receiving a compressed fluid, the discharge port configured to receive a working fluid from a direct pressure chamber and an indirect pressure chamber, wherein the orbiting scroll member includes:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step, and the third distance increases from a first point of the modified portion to a second point of the modified portion disposed at an end of the wrap member.

8. The scroll compressor according to claim 7, wherein the modified portion is arranged such that in a discharge configuration in which the direct pressure chamber and the indirect pressure chamber fluidly communicate with the discharge port, the modified portion provides an increased flow area for the indirect pressure chamber.

9. The scroll compressor according to claim 7, wherein a thickness of the base is relatively greater than a thickness of the step.

10. The scroll compressor according to claim 9, wherein the thickness of the step is relatively greater than a thickness of the scallop.

11. The scroll compressor according to claim 7, wherein the modified portion is disposed at a tip portion of the wrap member, the tip portion being disposed adjacent to a discharge port of the scroll compressor.

12. A method for increasing a flow area in a scroll compressor, comprising:

modifying a tip portion of an orbiting scroll member, wherein the orbiting scroll member includes a base member and a wrap member formed on a major surface of the base member, the modifying including forming the tip portion to include a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step, wherein the third distance increases from a first point of the modified portion to a second point of the modified portion disposed at an end of the wrap member.

13. The method according to claim 12, wherein the modifying includes forming the tip portion such that a thickness of the base is relatively greater than a thickness of the step.

14. The method according to claim 13, wherein the modifying includes forming the tip portion such that the thickness of the step is relatively greater than a thickness of the scallop.

15. A heating, ventilation, and air conditioning (HVAC) system, comprising:

a condenser, an evaporator, an expansion device, and a scroll compressor fluidly connected to form a heat transfer circuit, wherein the scroll compressor includes:

a compressor housing;

a non-orbiting scroll member and an orbiting scroll member intermeshed forming a compression chamber within the housing; and a discharge port for receiving a compressed fluid, the discharge port configured to receive a working fluid from a direct pressure chamber and an indirect pressure chamber, wherein the orbiting scroll member includes:

a base member; and a wrap member formed on a major surface of the base member;

wherein the wrap member includes a modified portion, the modified portion including a base, a step, and a scallop, the base extending a first distance from the major surface, the step extending a second distance from the base, the scallop extending a third distance from the step, the scallop being located at a wrap surface of the wrap member, the wrap surface being disposed relatively away from the major surface relative to the step, and the third distance increases from a first point of the modified portion to a second point of the modified portion disposed at an end of the wrap member.

16. The HVAC system according to claim 15, wherein the modified portion is arranged such that in a discharge configuration in which the direct pressure chamber and the indirect pressure chamber fluidly communicate with the discharge port, the modified portion provides an increased flow area for the indirect pressure chamber.

17. The HVAC system according to claim 15, wherein a thickness of the base is relatively greater than a thickness of the step.

18. The HVAC system according to claim 17, wherein the thickness of the step is relatively greater than a thickness of the scallop.

19. The HVAC system according to claim 15, wherein the modified portion is disposed at a tip portion of the wrap member, the tip portion being disposed adjacent to a discharge port of the scroll compressor.

* * * * *